US005090090A

United States Patent [19]

Temburg et al.

[11] Patent Number: 5,090,090

[45] Date of Patent: Feb. 25, 1992

[54] OPENING APPARATUS FOR REMOVING FIBER FROM COMPRESSED FIBER BALES

[75] Inventors: Josef Temburg, Niersstrasse; Ferdinand Leifeld, von-Behring-Strasse; Ulrich Vollrath, Am Röttgen, all of Fed. Rep. of Germany

[73] Assignee: Trützschler GmbH Co. KG, Mönchengladbach, Fed. Rep. of Germany

[21] Appl. No.: 570,877

[22] Filed: Aug. 22, 1990

[30] Foreign Application Priority Data

Aug. 31, 1989 [DE] Fed. Rep. of Germany ..... 3928835

[51] Int. Cl.[5] ..... D01G 7/04

[52] U.S. Cl. ..... 19/80 R

[58] Field of Search ..... 19/80 R, 81, 97, 97.5, 19/105, 145.5

[56] References Cited

U.S. PATENT DOCUMENTS

| | | | |
|---|---|---|---|
| 4,477,944 | 10/1984 | Binder et al. | 19/80 R |
| 4,493,131 | 1/1985 | Dragagna et al. | 19/80 R |
| 4,513,479 | 4/1985 | Binder et al. | 19/80 R |
| 4,660,257 | 4/1987 | Binder et al. | 19/81 X |
| 4,662,031 | 5/1987 | Felks et al. | 19/80 R |
| 4,687,147 | 8/1987 | Hergeth | 19/80 R X |
| 4,707,888 | 11/1987 | Binder et al. | 19/80 R |
| 4,748,725 | 6/1988 | Temburg et al. | 19/80 R |
| 4,756,059 | 7/1988 | Temburg | 19/80 R |
| 4,780,933 | 11/1988 | Pinto et al. | 19/80 R |
| 4,796,334 | 1/1989 | Yecheskel et al. | 19/80 R |
| 4,796,335 | 1/1989 | Kranefeld et al. | 19/80 R |
| 4,928,354 | 5/1990 | Hanselmann et al. | 19/97 |
| 4,995,142 | 2/1991 | Binder et al. | 19/80 R |

FOREIGN PATENT DOCUMENTS

| | | | |
|---|---|---|---|
| 0069847 | 1/1983 | European Pat. Off. . | |
| 0283653 | 9/1988 | European Pat. Off. . | |
| 326913 | 8/1989 | European Pat. Off. . | |
| 3335793 | 4/1985 | Fed. Rep. of Germany | 19/80 R |
| 3722317 | 1/1989 | Fed. Rep. of Germany . | |
| 8712308 | 2/1989 | Fed. Rep. of Germany . | |
| 3738148 | 5/1989 | Fed. Rep. of Germany . | |
| 2070087 | 9/1981 | United Kingdom . | |
| 2172908 | 10/1986 | United Kingdom . | |
| 2222606 | 3/1990 | United Kingdom . | |

*Primary Examiner*—Werner H. Schroeder
*Assistant Examiner*—Ismael Izaguirre
*Attorney, Agent, or Firm*—Spencer & Frank

[57] ABSTRACT

A bale opener arranged for travel along a series of fiber bales for removing fiber tufts from top surfaces thereof. The bale opener includes a toothed opening roll supported in an orientation transverse to a direction of travel and a grate formed of grate bars spaced in a direction transverse to the direction of travel and arranged for engaging the top surfaces of the fiber bales. The teeth of the opening roll extend between the grate bars for penetrating into the fiber bales during travel. There are further provided bale pressing elements supported by the bale opener on opposite sides of the opening roll spaced therefrom parallel to the direction of travel. The bale pressing elements are arranged to engage and press down the fiber bales during travel of the bale opener. A setting arrangement simultaneously vertically adjusts the bale pressing elements in opposite directions.

16 Claims, 5 Drawing Sheets

INPUTTING DEVICE
MEMORY
20

14
CONTROL DEVICE
21
13
TRANSDUCER
24
A
B
2
3
E
15
8a
11
5a
5
2a
8b
4
9
12
4a
6a
F
10
4a''
4a'
6'
6b
4a
1a
1
16
17
17a

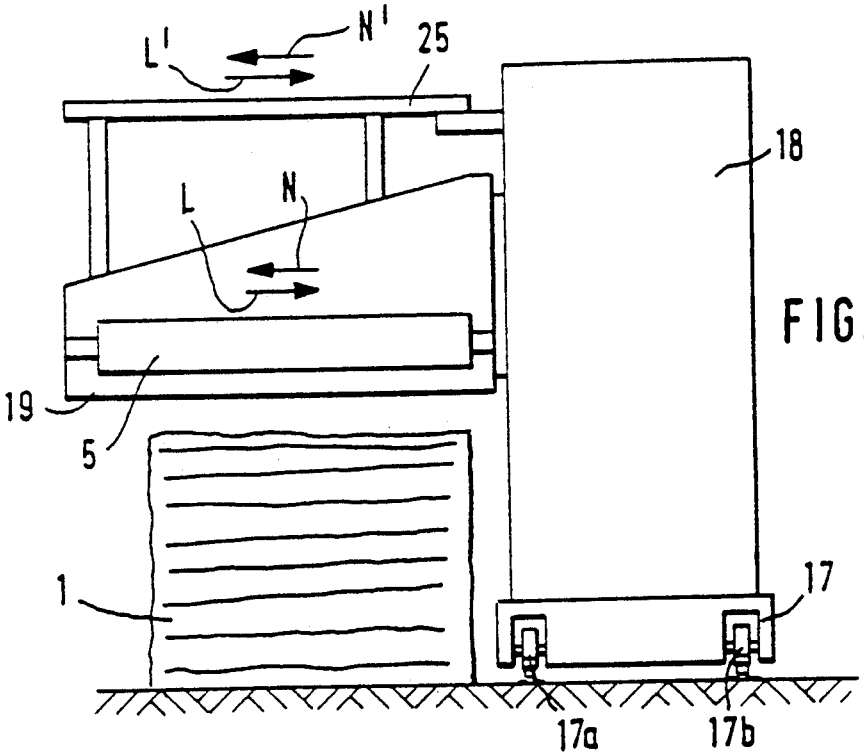
FIG. 3
FIG. 4
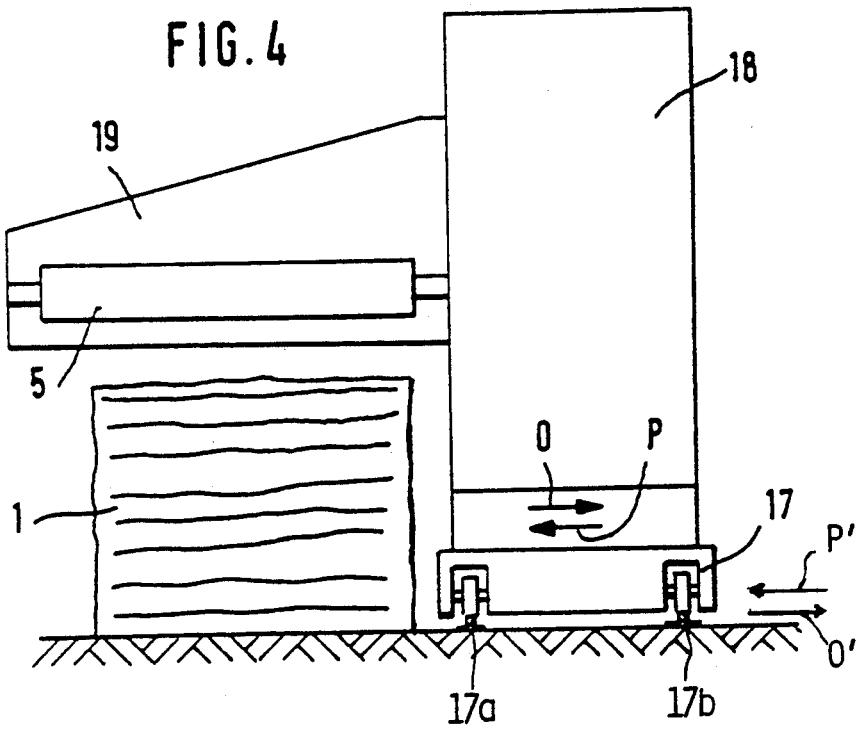

FIG. 5
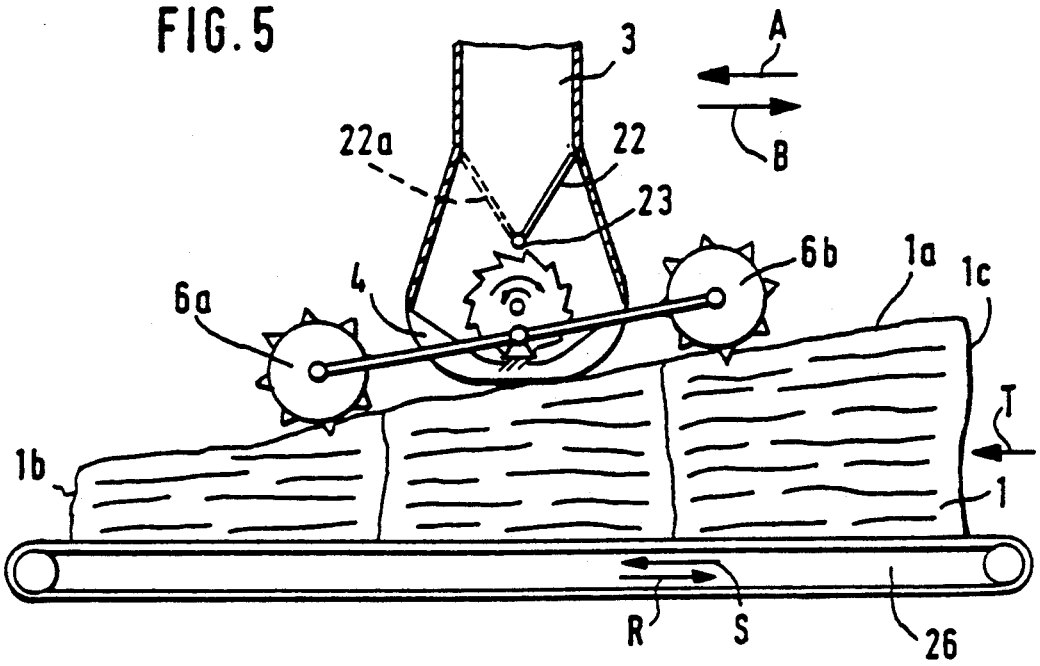
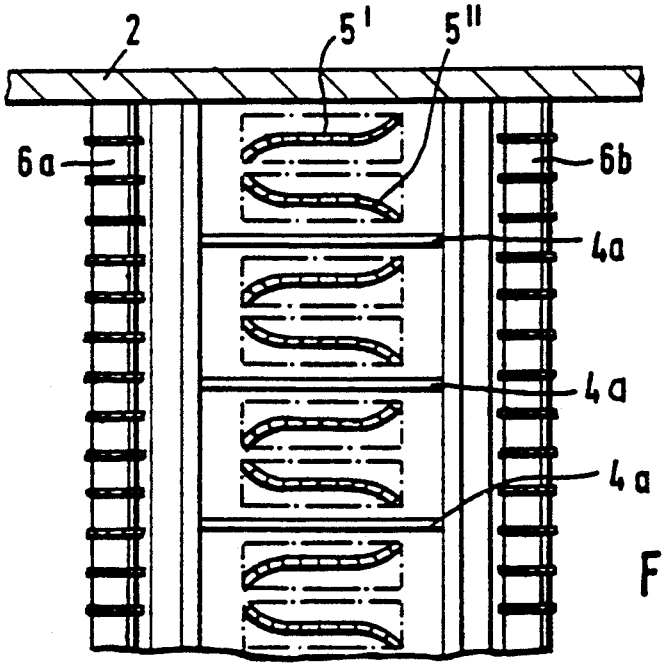
FIG. 6

OPENING APPARATUS FOR REMOVING FIBER FROM COMPRESSED FIBER BALESCROSS REFERENCE TO RELATED APPLICATION

This application claims the priority of Federal Republic of Germany Application No. P 39 28 835.8 filed Aug. 31st, 1989, which is incorporated herein by reference.

BACKGROUND OF THE INVENTION

This invention relates to an opening apparatus for opening fiber bales, that is, for removing fiber tufts from top faces of fiber bales. The apparatus is of the type which has a single, rapidly rotating opening roll which is composed of axially side-by-side arranged, sawtooth edged opening discs or which has a cylindrical surface provided with opening spikes or needles. The opening roll cooperates with a grate whose grate bars extend between the opening discs or circumferential rows of opening needles. The opening apparatus is arranged for travel above stationarily supported fiber bales and the teeth of the opening roll penetrate from above into the upper fiber bale surface.

A known opening apparatus of the above type comprises a tower which travels on horizontal rails and a cantilever projecting generally horizontally from the tower and adjustable to various angles to the longitudinal tower axis. In such a known arrangement, no bale support elements are provided so that the fiber bales may, during the opening operation, yield to operational pressing forces and thus shift or tip over. Further, turning the cantilever together with the opening device is structurally complex and expensive.

SUMMARY OF THE INVENTION

It is an object of the invention to provide an improved opening apparatus of the above-outlined type which, in particular, ensures the stability of the fiber bales and has a simpler construction than prior art devices.

This object and others to become apparent as the specification progresses, are accomplished by the invention, according to which, briefly stated, the opening roll is flanked on either side as viewed in the direction of travel, by a bale supporting element such as a bale pressing roll and further, setting means are provided for vertically shifting the bale support elements simultaneously in opposite directions.

By providing bale supporting elements such as bale pressing rolls, sliding shoes, inclined wall elements, pivotal plates or the like, pressure is exerted on the bales from above, as a result of which the bales are supported and cannot shift or tip over during the opening process. By virtue of the fact that, according to the invention, the bale support elements may be adjusted vertically simultaneously in opposite directions, a fiber tuft removal from the bale series may be performed in a plane which is inclined to the horizontal. It is a particular advantage of such an arrangement that only the bale supporting elements need to be shifted relative to the opening roll to achieve in a simple manner an opening process which progresses under different angles to the horizontal (obliquely oriented plane of removal). Thus, the cantilever, together with the opening device, need not be turned for achieving this purpose.

According to a further feature of the invention, the bale pressing rolls are vertically linearly adjustable.

According to a further feature of the invention, the bale pressing rolls may be shifted arcuately about an axis of rotation. Expediently, pneumatic, hydraulic or electric power means (cylinders) may be used as power sources for effecting the vertical adjustment of the bale pressing elements.

The setting means are preferably form-fitting setting elements, such as chains or sprockets, tooth belts and belt sprockets, gears or toothed racks, and the like.

According to another preferred embodiment in which the vertical feed of the cantilever arm and the travel motion of the tower are determined and coordinated by a control device, the shift of the bale pressing rolls is effected as a function of a preset angular position which is stored in a memory.

BRIEF DESCRIPTIONS OF THE DRAWINGS

FIG. 1 is a schematic side elevational view, with block diagram, of a preferred embodiment of the invention.

FIG. 2*a* is a schematic sectional side elevational view of another preferred embodiment of the invention illustrating a horizontal operational position.

FIG. 2*b* is a view similar to FIG. 2*a*, illustrating an operation along an inclined plane.

FIGS. 3 and 4 ar schematic end elevational views of two further preferred embodiments of the invention.

FIG. 5 is a schematic side elevational view of still another preferred embodiment of the invention.

FIG. 6 is a schematic top plan view of a component of the preferred embodiments.

Figure 7A:
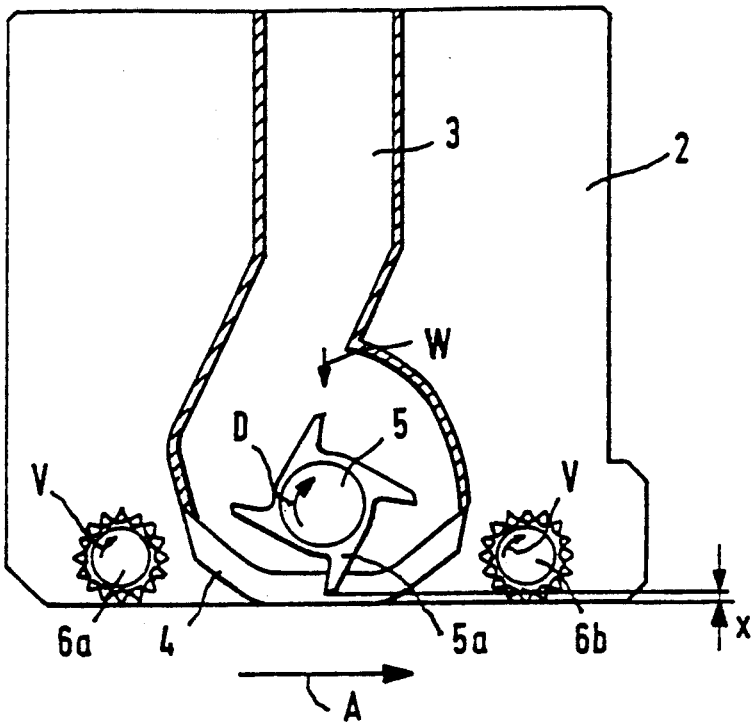
Figure 7B:
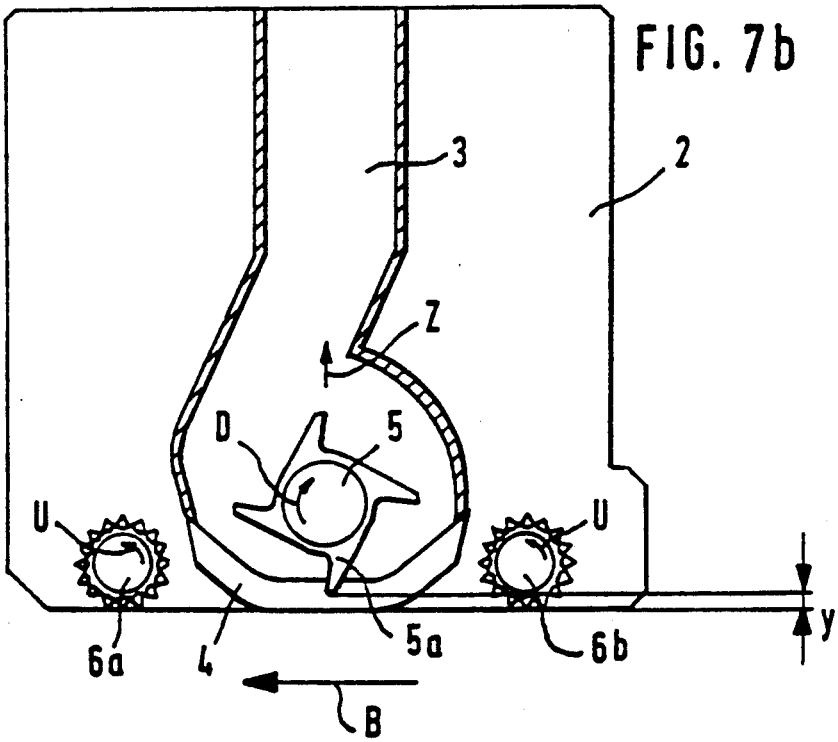

FIGS. 7*a* and 7*b* are schematic side elevational views of two further preferred embodiments of the invention.

DESCRIPTION OF THE PREFERRED EMBODIMENTS

Figure 1:
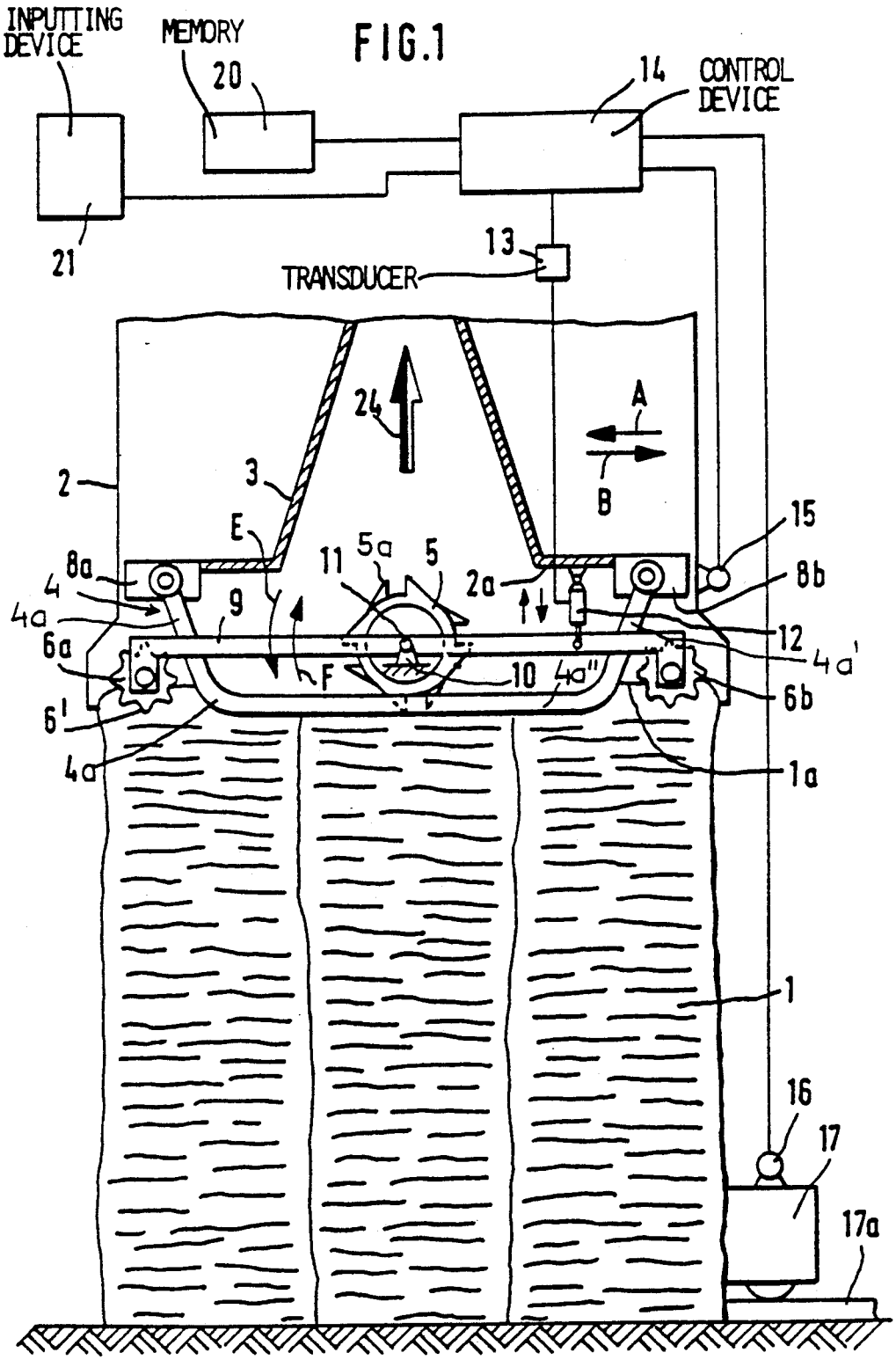

Turning to FIG. 1, there is illustrated therein a first preferred embodiment of the invention incorporated in an otherwise known bale opener which may be a BLENDOMAT BDT model, manufactured by Trëtzschler GmbH & Co. KG, Mönchengladbach, Federal Republic of Germany. The bale opener removes fiber tufts from the top faces of serially arranged fiber bales 1 as the bale opener travels therealong. The bale opener comprises a carriage 17 which is travelling horizontally back and forth on rails 17*a*. On the carriage 17 a vertically adjustable opening device is mounted which comprises a housing 2, a suction hood 3, a grate 4 and a rapidly rotating opening roll 5. The bale opener travels back and forth as indicated by arrows A and B.

The opening roll 5 is provided with teeth 5*a* which are arranged in circumferential series axially spaced from one another. The grate bars of the grate 4 extend in the axial clearance between the tooth series, so that the teeth 5*a* extend downwardly between the bars of the grate 4 to penetrate into the upper face 1*a* of the bales. The grate 4 lies on the surface 1*a* of the fiber bales whereby the latter are being held down and thus stabilized.

In front of and behind the opening roll 5 axially parallel bale pressing rolls 6*a*, 6*b* are provided which press down on the surface 1*a* of the fiber bales 1. In this manner, and by the penetration of the teeth 6' of the pressing rolls 6*a* and 6*b* the fiber bales are immobilized and are thus secured against shifting or tipping over as they are exposed to the operating forces of the bale opener. Further, the grate 4 secures the fiber layers of the fiber bales against a horizontal tearing or shifting by forces exerted by the opening roll 5.

The suction hood 3 is situated above the opening roll 5. In operation, the opening device travels with the opening roll 5 above the free-standing fiber bales 1, while the teeth 5*a* of the opening roll 5 tear fiber tufts from the surface 1*a* of the fiber bales 1 and throw the fiber tufts directly into the suction air stream 24 travelling in the suction hood 3. The fiber tufts are removed from the bale opener by a suction duct (not shown).

Also referring to FIG. 6, the grate 4 is formed of a plurality of grate bars 4*a* spaced from one another in a direction transverse to the travelling direction, that is, along the width of the fiber bale series. Each grate bar 4*a* essentially consists of three parts: first: and second ends 4*a*' as well as an intermediate mid zone 4*a*''. The first and second ends 4*a*' of each grate bar are oriented at an oblique angle to the bale surface 1*a*; the mid zone 4*a*'' of each grate bar is oriented substantially horizontally and lies on the bale surface 1*a*. The terminus of the first and second ends 4*a*' is secured to respective holding elements 8*a*, 8*b*.

The rotatable pressing rolls 6*a*, 6*b* are carried at opposite ends of a switchable, two-armed rocker 9 supported in a bearing 10 which has a shaft 11 attached to the rocker 9 to thus permit swinging motions of the rocker 9 as indicated by arrows E and F. In FIG. 1, the pressing rolls 6*a*, 6*b* and the rocker 9 are illustrated in a horizontal orientation at the beginning of a fiber bale opening operation. At this time, the bale surface 1*a* is essentially horizontal. By rotating the rocker 9 about the shaft 11, a vertical displacement of the pressing rolls 6*a*, 6*b* occurs in mutually opposite directions so that the opening roll 5, the pressing rolls 6*a*, 6*b* and the grate 4 move along a working plane which is inclined to the horizontal. The grate 4 too, may be arranged for pivotal motion about a horizontal rotary axis which is oriented transversely to the travelling direction of the bale opener.

Also referring to FIG. 3, there is shown therein a bale opener tower 18 mounted on the carriage 17 and a cantilever 19 which contains the opening roll 5 and which may be raised or lowered in a vertical direction relative to the tower 18. Considering FIGS. 1 and 3 together, to the rocker 9, at a distance from the pivot shaft 11, there is attached one end of the piston rod of a pneumatic cylinder 12 which, at its opposite end is secured to an inner wall 2*a* of the housing accommodating the opening device. The cylinder 12 is connected, through a transducer 13, with a control device 14 which, in turn, is connected to a hoisting motor 15 for the cantilever 19 and the motor 16 for driving the carriage 17. A memory 20 and an inputting device 21 are connected with the control device 14. The memory 20 and the inputting device 21 apply predetermined signals to the control device 14 for the stepwise adjustment of the vertical setting of the bale supporting elements (such as the pressing rolls 6*a*, 6*b*) as well as the vertical feed motion of the cantilever 19 by means of the hoisting motor 15 and the travel motion of the carriage 17 by means of the motor 16.

Figure 2A:
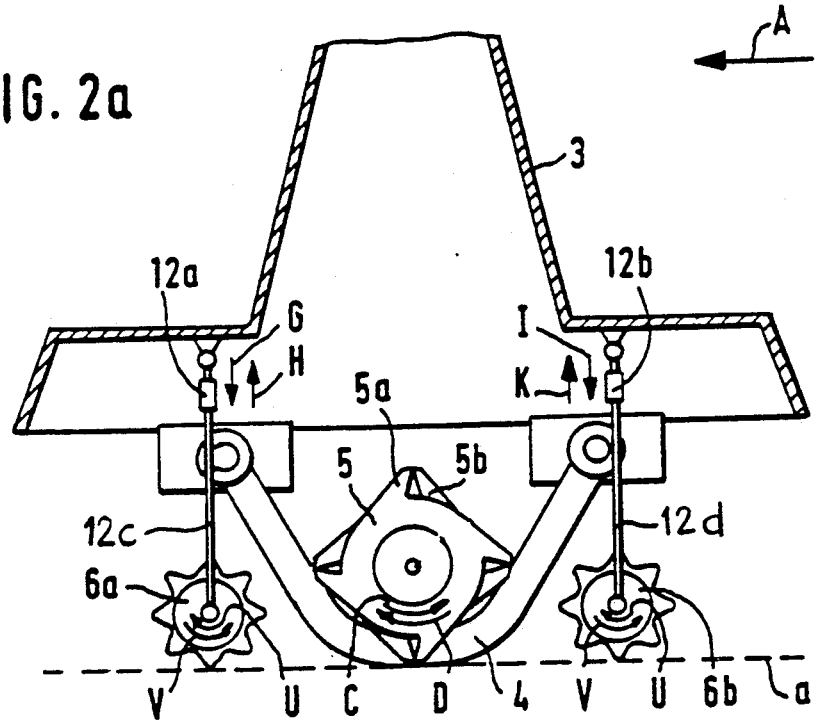
Figure 2B:
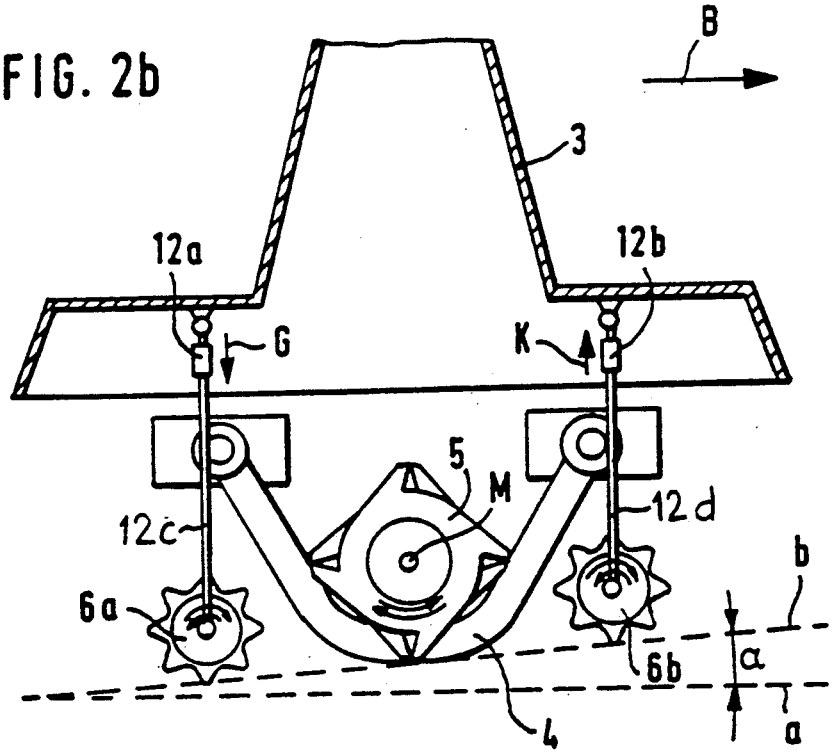

Turning to FIGS. 2*a* and 2*b*, to the pressing rolls 6*a* and 6*b* there are connected respective pneumatic cylinders 12*a* and 12*b* which exert vertical forces to roll supporting bars 12*c*, 12*d* in the direction of arrows G, H and I, K, respectively. In FIG. 2*a* the pressing rolls 6*a*, 6*b* are arranged in a horizontal plane a, while in FIG. 2*b* the pressing roll 6*a* has been displaced in the direction of the arrow G downwardly such that the lowest point of the pressing roll 6*a* is at a level below the lowest point of the opening roll 5, whereas simultaneously, the pressing roll 6*b* has been raised vertically in the direction of the arrow K such that the lowest point of the pressing roll 6*b* is at a level above the lowest point of the opening roll 5. By such a shift in opposite directions, the pressing rolls 6*a*, 6*b* are oriented in an oblique plane b forming an angle $\alpha$ with the horizontal plane a. The opening roll 5 need not be displaced to obtain such an oblique plane. A and B indicate the travelling direction (working direction) of the bale opener.

The opening roll 5 has, on a central core member, a plurality of axially spaced annular toothed discs. The teeth 5*a* and 5*b* of consecutive discs are oriented in opposite directions of rotation. By virtue of such an arrangement, the opening process can be performed by a single opening roll 5 in the one and the other working direction A, B to thus remove fiber tufts from the upper bale surface 1*a*. The grate 4 has a slightly curved mid zone underneath the opening roll 5 making possible a smooth adaptation during transition from the horizontal plane a to the inclined plane b.

As illustrated in FIG. 3, the cantilever 19 is, together with the opening roll 5, horizontally shiftable in the direction of the arrows L and N towards and away from the opener tower 18 by means of a shifting device 25. As an alternative, with a similar, non-illustrated, shifting device mounted on the carriage 17, the tower 18 is, together with the cantilever 19 horizontally shiftable relative to the carriage 17 in the direction of arrows O, P transversely to the direction of travel, as illustrated in FIG. 4. As a further alternative, the rails 17*a*, 17*b* may be shiftable in the directions O', P' to effect a horizontal transverse shift of the bale opener. By virtue of the above-described transverse shift of the opening roll 5 after each pass to an extent which is one-half the distance between grate bars, burrows and ridges formed during the opening operation in the fiber bale surface can be compensated for.

Turning to FIG. 5, there are illustrated therein fiber bales 1 positioned on a conveyor belt 26 movable in the direction of the arrows R, S. As the opening operation progresses along an inclined plane, new, full-height fiber bales are added to the series in the direction T in a continuous manner. In the suction hood 3 a routing plate 22 is arranged which is pivotal about a pin 23 and which is switchable from one of its limit positions (solid-line illustration) to the other (dash-dotted position 22*a*) as the direction of travel is reversed. The grate 4 and/or the opening roll 5 may be shiftable beyond the vertical end faces 1*b* and 1*c* of the fiber bale series.

Turning once again to FIG. 6, the adjoining toothed opening discs 5', 5'' are shown with right-hand and, respectively left-hand turns; the teeth 5*a* and 5*b* in the adjoining respective discs 5' and 5'' are oriented in opposite directions of rotation as shown in FIGS. 1, 2*a* and 2*b*.

Turning to FIGS. 7*a* and 7*b*, the opening roll 5, irrespective of the travelling direction A or B, rotates at all times in the same direction as indicated by the arrow D. The pressing rolls 6*a*, 6*b* rotate inthe direction V when the opening device travels in direction A and they rotate in the direction U when the opening device travels in the direction B. The opening roll 5 is, in the travelling direction A (FIG. 7) displaced by means of a non-illustrated setting motor in the direction of the arrow W downwardly so that the distance of the outermost points of the teeth 5*a* is at a distance x from the lowermost point of the grate 4. According to FIG. 7*b*, the opening roll 5 is, when travel is in the direction B, moved vertically upwardly as indicated by the arrow Z to change the distance of the points of the teeth 5*a* from the lowermost point of the grate 4 to the distance y. Distance x being smaller than distance y, the quantity of the removed fiber tufts remains the same in the travelling directions A and B in case all teeth in the opening roll are uniformly oriented, that is, they point in the same direction as the direction of rotation D.

It will be understood that the above description of the present invention is susceptible to various modifications, changes and adaptations, and the same are intended to be comprehended within the meaning and range of equivalents of the appended claims.

What is claimed is:

1. In a bale opener for travel along a series of fiber bales for removing fiber tufts from top surfaces thereof, including a toothed opening roll supported in an orientation transverse to a direction of travel, a grate formed of grate bars spaced in a direction transverse to the direction of travel for engaging the top surfaces of the fiber bales; the teeth of the opening roll extending between the grate bars for penetrating into the fiber bales during travel; the improvement comprising bale pressing elements supported by the bale opener on opposite sides of the opening roll spaced therefrom parallel to the direction of travel for pressing downwardly on the fiber bales during travel of the bale opener; setting means for simultaneously vertically adjusting said bale pressing elements in opposite directions; a carriage for travelling alongside the fiber bales; a tower mounted on the carriage for travel therewith as a unit; a cantilever mounted on the tower for extending over the fiber bales in a direction transverse to the travelling direction; said opening roll, said grate and said bale pressing elements being accommodated in said cantilever; said cantilever being vertically movable relative to said tower; said rails, together with said carriage, said tower and said cantilever being horizontally movable in a direction transverse to the direction of travel.

2. In a bale opener for travel along a series of fiber bales for removing fiber tufts from top surfaces thereof, including a toothed opening roll supported in an orientation transverse to a direction of travel, a grate formed of grate bars spaced in a direction transverse to the direction of travel for engaging the top surfaces of the fiber bales; the teeth of the opening roll extending between the grate bars for penetrating into the fiber bales during travel; the improvement comprising bale pressing elements supported by the bale opener on opposite sides of the opening roll spaced therefrom parallel to the direction of travel for pressing downwardly o the fiber bales during travel of the bale opener; setting means for simultaneously vertically adjusting said bale pressing elements in opposite directions; a tower for travelling alongside the fiber bales, a cantilever mounted on the tower for extending over the fiber bales in a direction transverse to the travelling direction of the tower; said opening roll, said grate and said bale pressing elements being accommodated in said cantilever; said cantilever being vertically movable relative to said tower; and means for moving the cantilever and the opening roll as a unit horizontally relative to the tower in a direction transverse to the direction of travel.

3. A bale opener as defined in claim 2, wherein said cantilever is horizontally movable transverse to the direction of travel at the end of each travel in one direction by a distance corresponding to one half the spacing between adjoining grate bars.

4. In a bale opener for travel along a series of fiber bales for removing fiber tufts from top surfaces thereof, including a toothed opening roll supported in an orientation transverse to a direction of travel, a grate formed of grate bars spaced in a direction transverse to the direction of travel for engaging the top surfaces of the fiber bales; the teeth of the opening roll extending between the grate bars for penetrating into the fiber bales during travel; the improvement comprising bale pressing elements supported by the bale opener on opposite sides of the opening roll spaced therefrom parallel to the direction of travel for pressing downwardly on the fiber bales during travel of the bale opener; setting means for simultaneously vertically adjusting said bale pressing elements in opposite directions; a carriage for travelling alongside the fiber bales; a tower mounted on the carriage for travel therewith as a unit; a cantilever mounted on the tower for extending over the fiber bales in a direction transverse to the travelling direction; said opening roll, said grate and said bale pressing elements being accommodated in said cantilever; said cantilever being vertically movable relative to said tower; said tower and said cantilever being horizontally movable as a unit relative to the carriage in a direction transverse to the direction of travel.

5. A bale opener as defined in claim 4, wherein said tower and said cantilever are horizontally movable transverse to the direction of travel at the end of each travel in one direction by a distance corresponding to one half the spacing between adjoining grate bars.

6. In a bale opener for travel along a series of fiber bales for removing fiber tufts from top surfaces thereof, including a toothed opening roll supported in an orientation transverse to a direction of travel, a grate formed of grate bars spaced in a direction transverse to the direction of travel for engaging the top surfaces of the fiber bales; the teeth of the opening roll extending between the grate bars for penetrating into the fiber bales during travel; the improvement comprising bale pressing elements supported by the bale opener on opposite sides of the opening roll spaced therefrom parallel to the direction of travel for pressing downwardly on the fiber bales during travel of the bale opener; setting means for simultaneously vertically adjusting said bale pressing elements in opposite directions; a carriage for travelling alongside the fiber bales; a tower mounted on the carriage for travel therewith as a unit; a cantilever mounted on the tower for extending over the fiber bales in a direction transverse to the travelling direction; said opening roll, said grate and said bale pressing elements being accommodated in said cantilever; said cantilever being vertically movable relative to said tower; said carriage, said tower and said cantilever being horizontally movable as a unit in a direction transverse to the direction of travel.

7. A bale opener as defined in claim 6, wherein said carriage, said tower and said cantilever are horizontally movable transverse to the direction of travel at the end of each travel in one direction by a distance corresponding to one half the spacing between adjoining grate bars.

8. In a bale opener for travel along a series of fiber bales for removing fiber tufts from top surfaces thereof, including a toothed opening roll supported in an orientation transverse to a direction of travel, a grate formed of grate bars spaced in a direction transverse to the direction of travel for engaging the top surfaces of the fiber bales; the teeth of the opening roll extending between the grate bars for penetrating into the fiber bales during travel; the improvement comprising pressing rolls supported by the bale opener on opposite sides of the opening roll spaced therefrom parallel to the direction of travel for pressing downwardly on the fiber bales during travel of the bale opener; said pressing rolls being oriented parallel to said opening roll; and setting means for simultaneously vertically adjusting said bale pressing elements in opposite directions; said setting means including a two-armed rocker supported by a pivot for rotary motion about a horizontal pivot axis; said two-armed rocker having opposite ends carrying said pressing rolls for shifting said pressing rolls in an arcuate path.

9. A bale opener as defined in claim 8, wherein said setting means comprises a power means connected to said two-armed rocker for setting the two armed rocker into a desired angular position.

10. A bale opener as defined in claim 9, wherein said power means comprises a hydraulic cylinder.

11. In a bale opener for travel along a series of fiber bales for removing fiber tufts from top surfaces thereof, including a toothed opening roll supported in an orientation transverse to a direction of travel, a grate formed of grate bars spaced in a direction transverse to the direction of travel for engaging the top surfaces of the fiber bales; the teeth of the opening roll extending between the grate bars for penetrating into the fiber bales during travel; the improvement comprising bale pressing elements supported by the bale opener on opposite sides of the opening roll spaced therefrom parallel to the direction of travel for pressing downwardly on the fiber bales during travel of the bale opener; and setting means for simultaneously vertically adjusting said bale pressing elements in opposite directions in a range extending from a lower limit in which a lowest power of one of the pressing elements is at a level below a lowest point of said opening roll to an upper limit in which said lowest point of said one pressing element is at a level above said lowest point of said opening roll for effecting a fiber tuft removal from the series of fiber bales in a plane inclined to a horizontal plane.

12. A bale opener as defined in claim 11, wherein said opening roll comprises a plurality of axially side-by-side arranged discs each having peripheral teeth; the teeth on each disc being arranged in a circumferential series of helical path; said helical path being oppositely oriented in axially consecutive discs; said teeth in each said circumferential series having an inclined orientation; said teeth in adjoining said circumferential series being inclined in opposite directions.

13. A bale opener as defined in claim 11, wherein said opening roll comprises a plurality of axially side-by-side arranged discs each having peripheral teeth in a circumferential series; consecutive teeth in each series being offset as viewed circumferentially; said teeth in each said circumferential series having an inclined orientation; said teeth in adjoining said circumferential series being inclined in opposite directions.

14. A bale opener as defined in claim 11, further comprising a tower for travelling alongside the fiber bales; a cantilever mounted on the tower for extending over the fiber bales in a direction transverse to the travelling direction of the tower; said opening roll, said grate and said bale pressing elements being accommodated in said cantilever; said cantilever being vertically movable relative to said tower; and a control means for coordinating the travel of said tower with vertical motions of said cantilever.

15. A bale opener as defined in claim 11, wherein said setting means include means for linearly shiftier said pressing rolls.

16. A bale opener as defined in claim 11, further comprising a tower for travelling alongside the fiber bales, a cantilever mounted on the tower for extending over the fiber bales in a direction transverse to the travelling direction of the tower; said opening roll, said grate and said pressing rolls being accommodated in said cantilever; said cantilever being vertically movable relative to said tower; means for coordinating the travel of said tower with vertical motions of said cantilever; and means for controlling said setting means for placing said pressing rolls in an inclined plane relative to one another as a function of a settable angle to the horizontal, stored in a memory forming part of said means for con&rolling said setting means.

* * * * *